United States Patent [19]

Leich

[11] 3,967,526

[45] July 6, 1976

[54] APPARATUS FOR LUBRICATING AND SIZING SLUGS

[75] Inventor: Robert A. Leich, Southfield, Mich.

[73] Assignee: Camdex, Inc., Warren, Mich.

[22] Filed: June 10, 1974

[21] Appl. No.: 477,651

[52] U.S. Cl. ..... 86/19; 86/27; 184/7 D

[51] Int. Cl.[2] ..... F42B 31/02

[58] Field of Search ..... 86/1, 19, 23, 24, 25, 86/26, 27, 31, 42, 43; 137/569; 184/6, 7 D

[56] References Cited

UNITED STATES PATENTS

| | | | |
|---|---|---|---|
| 620,350 | 2/1899 | McGrail | 86/19 |
| 2,019,795 | 11/1935 | Peterson | 86/19 |
| 2,535,616 | 12/1950 | Wadman et al. | 86/19 |
| 2,557,334 | 6/1951 | Zwack | 137/569 X |
| 3,005,372 | 10/1961 | Hall | 86/19 |
| 3,483,792 | 12/1969 | Williams | 86/27 |
| 3,706,255 | 12/1972 | Magnuson | 86/26 X |
| 3,857,319 | 12/1974 | Welch | 86/23 |

FOREIGN PATENTS OR APPLICATIONS

| | | | |
|---|---|---|---|
| 38,797 | 8/1886 | Germany | 86/27 |

*Primary Examiner*—Samuel W. Engle
*Assistant Examiner*—Harold Tudor
*Attorney, Agent, or Firm*—Thomas N. Young

[57] ABSTRACT

An automated machine for lubricating and sizing cast lead slugs and including a body having a slug passage comprising vertical and horizontal legs extending therethrough, the horizontal portion of said passage including a sizing die which insures a uniform slug diameter. A crank-driven ram pushes the slugs through the horizontal leg of the passage intermittently and meters the slugs into the vertical leg of the passage by means of a sliding transfer bar arrangement. Semifluid lubricant is fed from a pressurized supply into the die chamber by means of a cam driven pump plunger so as to fill the lubricating rings of each slug as it momentarily rests within the sizing die chamber. A single motor drives the transfer ram as well as the lubricant plunger so as to synchronize the slug metering and lubricating operations. A ball check valve permits excess lubricant to be discharged from the die chamber.

12 Claims, 4 Drawing Figures

3

APPARATUS FOR LUBRICATING AND SIZING SLUGS

INTRODUCTION

This invention relates to apparatus for manufacutring ammunition and more particularly to a machine for continuously and automatically lubricating and sizing cast slugs.

BACKGROUND OF THE INVENTION

It is well known that the manufacture of ammunition including rifle and pistol bullets is best carried out by way of an automated apparatus having a plurality of stations in which the various ammunition manufacturing steps are performed, and a transfer mechanism for moving the cartridges between the various stations. An automated ammunition assembly device is disclosed in my previously issued U.S. Pat. No. 3,714,860 issued Feb. 6, 1973.

Where lead slugs and the like are to be inserted into powder-filled casings in an automated assembly process, it is first essential to lubricate the slugs and further to insure that they are all of a uniform diameter. Lubrication is typically performed by filling circumferential lubricating grooves with a commercial lubricant such as semifluid wax-base material. The sizing operation is typically carried out by passing the slugs through an accurately machined die.

BRIEF SUMMARY OF THE INVENTION

This invention relates to an apparatus which automatically and substantially continuously performs the lubricating and sizing opertions described above as essential steps to be carried out prior to an automated ammunition assembly process.

In general, the lubricating and sizing operations are carried out in an apparatus comprising a body defining first and second passages of which the first passage is pre-sized for receiving slugs for intermittent movement therethrough and the second passge is on one end in communication with the source of semifluid lubricating material and on the other end in communication with the first passage and second means are provided for metering lubricant from the source to the first passage by way of the second passage. Finally, the apparatus comprises power means for cyclically operating the first and second metering means in a predetermined timed relationship.

As will be more fully and specifically set forth hereinafter, the apparatus comprises in the preferred and illustrative form a motor driving a ram mounted for horizontal reciprocal motion on guide pins which are attached to a steel body which defines a slug passage and a lubricant passage. Each stroke of the ram moves a single slug from a stack of juxtaposed slugs into the first passage and thereafter pushes the slugs through a sizing die carried by the body. In addition the apparatus comprises a plunger pump which is driven by the motor to apply pressure to an accurately metered quantity of lubricant so as to force the lubricant into the area around each slug as it rests momentarily within the sizing die.

The various features and advantages of the present invention will be made more apparent in the following specification which is to be taken with the accompanying drawings.

DETAILED DESCRIPTION OF THE SPECIFIC EMBODIMENT

GENERAL STRUCTURAL DESCRIPTION

Figure 1:
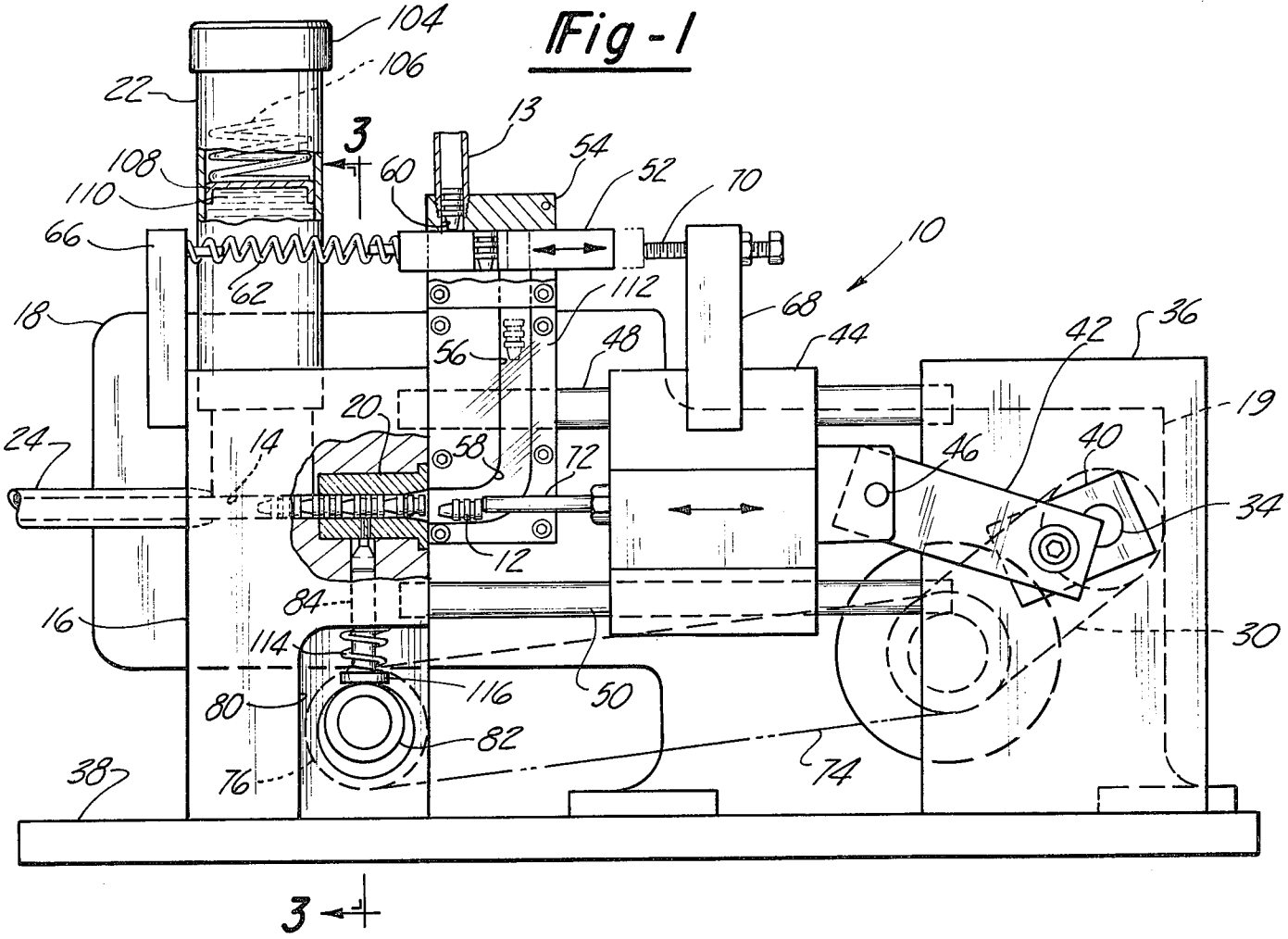
FIG. 1 is a side view partly in section of an apparatus for lubricating and sizing cast slugs and embodying the various features and advantages of the invention.
Figure 2:
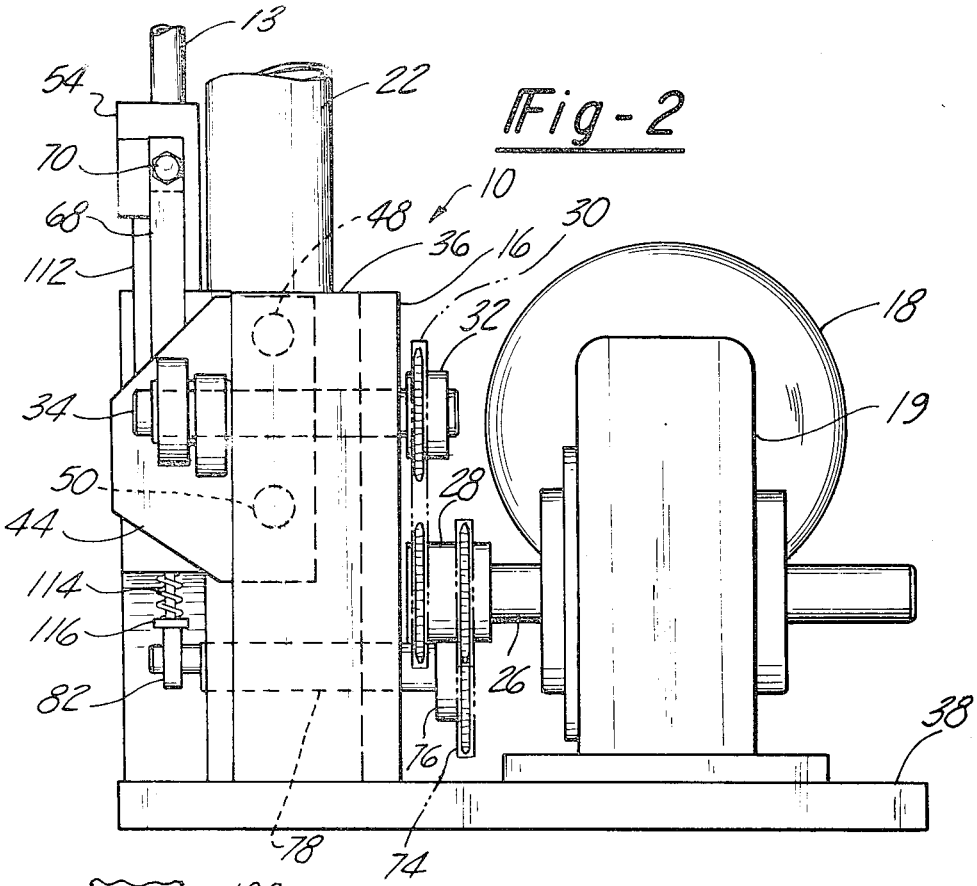
FIG. 2 is an end view of the apparatus of FIG. 1.

Looking to FIGS. 1 and 2 there is shown a machine 10 for lubricating and sizing grooved cast lead slugs 12 as the slugs are metered from a vertical stack tube 13 into a horizontal first passage 14 in a rigid steel body 16. The sizing operation is carried out by passing the slugs 12 through a precision die 20 which is removably press fit into the body 16 and which forms part of the passage 14 as best shown in FIG. 1. The lubricating step is carried out by pressure feeding a quantity of wax-base, semifluid lubricant from a cylindrical tubular container 22 which is threadedly engaged with the body 16 and connected to passage 14 by a second passage hereinafter defined. The sized and lubricated slugs are discharged into a detachable plastic tube 24 so as to facilitate transfer of a plurality of slugs to an automated ammunition assembly machine.

Considering now the apparatus of FIGS. 1 and 2 in greater detail, machine 10 comprises a motor 18 having the output shaft thereof connected to the input of a reduction gear drive unit 19 to provide low-speed mechanical inputs to the slug-metering and lubricant-metering devices hereinafter described. Both motor 18 and reduction drive unit 19 are secured to a common base 38. Reduction drive unit 19 includes an output shaft 26 carrying a double chain sprocket 28. A first drive chain 30 extends to a sprocket 32 on one end of a shaft 34 which extends through a support block 36 mounted on base 38. The other end of shaft 34 is connected to a crank assembly 40, 42, the output end of crank arm 42 being pivotally connected to a ram 44 at pivot 46. The ram 44 is supported on parallel guide bars 48 and 50 which are rigidly secured to and between the body 16 and the support block 36. Accordingly, the ram 44 is capable of reciprocal horizontal displacement between the body 16 and the block 36 according to the rotation of the sprocket 32 and shaft 34.

SLUG METERING STRUCTURE

The reciprocating ram accomplishes two operations which, together, constitute the slug metering system. The first operation is the reciprocation of a sliding transfer bar 52 within a transfer assembly 54 which is rigidly connected to and disposed in juxtaposed relationship with the body 16. The second operation involves pushing the slugs through passage 14.

Looking first to the slug metering operation, it will be noted that the vertical axis of supply tube 13 is offset from the vertical passage 56 in the assembly 54. To transfer slugs 12 from the tube 13 to the passage 56, the slidebar 52 is provided with a single slug receptacle 60 such that as the slidebar 52 reciprocates back and forth under the control of the ram 44, a single slug from tube 13 drops into the receptacle 60 when the receptacle is aligned with the axis of tube 13. An extension 68 suitably secured to the ram 44 is provided with a threaded pusher screw 70 which engages the transfer bar 52 to push the bar to the left as the ram advances toward the body. The slidebar is then urged to the right by a bias spring 62 as the ram 44 moves away from body 16. Spring 62 bears against a plate 64 rigidly secured to the left side of the body 16 as shown in FIG. 1. Bar 52 slides in assembly 54 until the receptacle 60 is aligned with the vertical passage 56. At this time the slug in the receptacle 60 drops into the vertical portion of the slug metering passage 14, 56, 58, and slides under the force of gravity to the bottom of the passage. The slug easily rounds the curved passage area 56 and stops in a position of substantial alignment with the horizontal portion of the passage 14. The threaded pusher screw 70 permits a fine adjustment in the operating positions of the bar 52 so as to insure the continuous and fault-free metering of the slugs from the supply stack 13 into the passage 56.

To push the slugs 12 through passage 14, ram 44 carries a pushrod 72 which extends through an opening in the assembly 54 which is in substantial alignment with the horizontal passage 14 through the body 16. As the ram progresses from right to left as shown in FIG. 1, the pushrod 72 engages the rear surface of the slug 12 which has just dropped down through the vertical passage 56 and pushes that slug through the opening in the die 20 and into the passage 14. It will be noted that a stacked series of slugs 12 is disposed in the passage 14 during a typical continuous operation. Thus, each reciprocal cycle of movement of ram 44 produces an incremental advance of the slugs through the passage 14. The timing is such that the slugs 12 drop down the vertical portion 56 of the metering passage when the pushrod 72 is withdrawn.

LUBRICANT METERING

Figure 3:
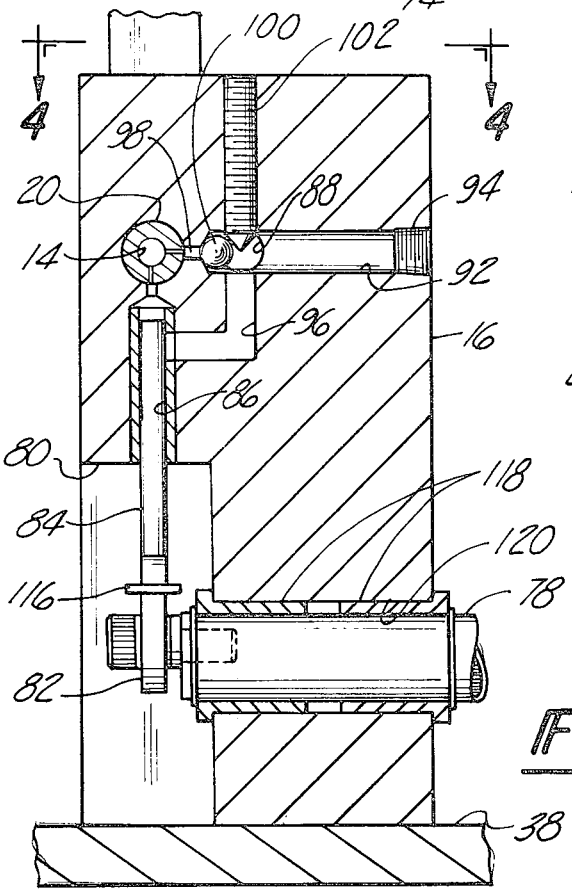
FIG. 3 is a section through the body of the apparatus of FIG. 1 illustrating the lubrication system.
Figure 4:
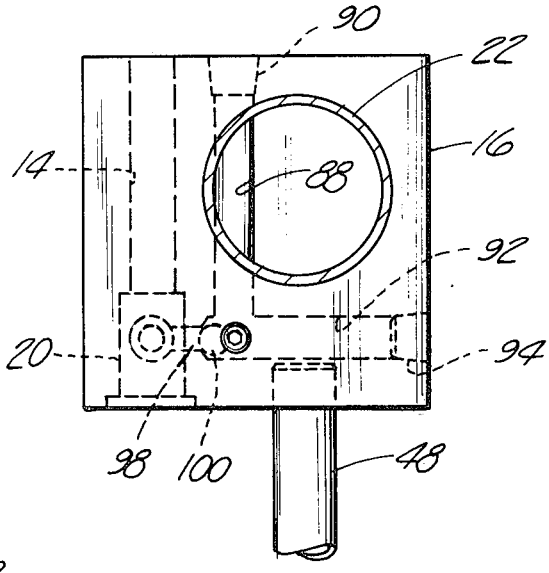
FIG. 4 is a top view of the body of FIG. 3 indicating further details of the lubrication system.

Considering now the lubrication system, the drawings show the double chain pulley 28 to carry a second chain 74 which extends forwardly to a driven pulley 76 on one end of a shaft 78 which is rotatably disposed within the body 16. A recessed portion 80 of body 16 accommodates an eccentric cam 82 which is carried on the other end of the shaft 78 and which bears against the lower end or follower 116 of a lubricant pump plunger 84 which is aligned at right angles with the passage 14 in the vicinity of the sizing die 20 as best shown in FIG. 3 The plunger 84 thus reciprocates within a cylindrical bore 86 in body 16 to apply metered amounts of lubricant from supply source 22 to each slug 12 as it momentarily stops within the sizing die 20.

Considering now the intercommunications between the lubricant supply source 22 and the slug metering passage 14 in the vicinity of the die 20, FIG. 1 shows the container 20 to be threaded into the body 16 for a distance of approximately 1½ inches. The threaded bore in the body 16 which receives the container 22 communicates at the lower end thereof with a horizontal passage 88 which is bored into body 16 and then sealed by cap 90 threaded into the body 16. Passage 88 communicates directly with laterally bored passage 92 which is sealed by threaded cap 94. Passage 92 communicates directly with passage 96 which extends to and opens into passage 86 which carries the pump plunger 84. The point of interconnection between passage 96 and 86 is spaced downwardly from the upper end of passage 86 by a sufficient distance so as to provide volume to receive a metered amount of semifluid lubricant material when the pump plunger 84 is in the lowered or retracted position as seen in FIG. 3. It will be observed that the retraction of the pump plunger 86 serves to open the port of communication between passages 96 and 86. Conversely, when the plunger 84 is in the raised position, the plunger body serves to close this same port. Passage 86 is in direct communication with passage 14 as defined by the through-bore of the die 20.

It will also be noted that the through-bore of die 20 is connected by overflow passage 98 back to the supply passage 92, a check valve being implemented by a ball 100 which seats against the outlet port of passage 98 and is loosely held in position by means of a tapered end machine screw 102 in body 16. The position of the machine screw 102 is such to permit the ball 100 to be displaced off of the seat surrounding the outlet end of passage 98 whenever the pressure on the lubricant within the interior of the die 20 is greater than the pressure from the lubricant supply source 22. Thus, as the pump plunger 84 is pushed upwardly to seal off the port of passage 96, the presence of excess lubricant in the upper end of the passage 86 will create an excess pressure condition within the die 20 so as to displace the ball 100 off of the seat and allow the excess lubricant to be discharged back into the supply passage. Again, the operation of the pump 84 is maintained in a precise timed relationship with the slug metering procedure since both the pump for lubricant and the ram 44 for slug metering are driven by a common drive motor 18; in other words, the use of the double sprocket chain drive inherently synchronizes the slug feed operation with the slug lubricating operation.

The container 22 which comprises the lubricant supply is a heavy steel tube having a threaded lower end for engagement with the body 16 as previously described. A heavy steel cap 104 is threaded onto the upper end of the tube so as to provide a seat for a steel compression spring 106 which is disposed within the tube 22. The opposite end of the spring 22 bears against a plastic cup 108 which separates the lubricant material 110 from the compression spring pressurizing area so as to act as a seal. Accordingly the lubricant 110 is under pressure produced by the spring 106. This pressure is sufficient to cause the lubricant to flow through the passages 88, 92, and 96 to the plunger passage 86 whereupon it is forced into the interior chamber of the die 20 by action of the pump plunger 84.

It will be noted that the slugs 12 are of the type having a predetermined number of axially spaced lubricating grooves, these grooves being aligned with the holes in the die 20 so that each hole passes lubricant to a specific groove in the slug 12. Although slugs having two lubricating grooves are shown, it will be understood that other slug designs may be employed, the number of holes in the dies 20 being adjusted by die replacement or plugging as necessary.

In the way of miscellaneous detail, it will be observed that a transparent plastic plate 112 covers the passage 56 in the assembly 54 to provide the outside wall of the passage as well as to facilitate visual inspection of the metering system. The plate 112 may extend upwardly over the receptacle 60 in the transfer bar 52, again to provide an outside wall as well as to permit visual inspection. It will also be observed that the plunger 84 is positively driven upwardly by the eccentric cam 82 and is returned so as to follow the contour of the cam by a compression spring 114. The spring 114 is trapped between the enlarged follower 116 on the end of the pump plunger 84 and the upper exterior surface of the recess 80 in the body 16 as best shown in FIGS. 1 and 2. Finally a bronze bushing 118 is press fit into the bore 120 through the body 16 to provide a long-life bearing for the shaft 68 as it extends through the body to drive the eccentric cam 82. It will be understood that various other mechanical details of the machine 10 will be apparent from the drawing and specific explanation or description of same will be omitted for the sake of brevity.

OPERATION

In operation, slugs 12 are loaded head down into the supply tube 13 to insure a substantially uninterrupted supply of slugs for the sizing and lubricating operation. Lubricant 110 is packed into the source tube 22 and the cap and spring arrangement is put in place to pressurize the lubricant and produce a flow through the passages to the end port of passage 96 adjacent the passage 86 as shown in FIG. 3. The motor 18 is energized to produce reciprocating motion of the cam 44 as well as reciprocating motion of the pump plunger 84. The right to left movement of the ram 44 displaces the transfer bar 52 in the same direction against the bias of spring 62 until the receptacle 60 is in alignment with the axis of supply tube 13. At this time a slug 12 falls into the receptacle of transfer bar 52. Reverse reciprocal motion; i.e., movement from left to right under the expansion force of spring 62 until the receptacle 60 aligns with the passage 56. At this point, the pushrod 72 is also withdrawn from the passage 14 such that the slug 12 falls vertically downwardly around the curve and into the position in front of the pushrod 72 as shown in FIG. 1.

Assuming a number of such operations have occured, a continuous stack of slugs 12 exist in the passage 14 including that portion which extends through the center of the die 20. As the ram 44 advances again, the pushrod 72 urges the stack of slugs forward by the length of one slug 12, a given slug residing within the die 20 with the grooves of the slug in alignment with the lubricant holes or radial passages of the die 20. At this time the pump plunger 84 is driven by the eccentric cam 82 in the upward direction so as to close off the supply port in passage 96 and to drive the metered quantity of lubricant in the upper end of the passage 86 into the lubricating chamber defined by the die 20. Any excess lubricant unseats the ball 100 and returns the lubricant to the supply passage. The slugs 12 are intermittently advanced by the pushrod 72 in the manner described until the output tube 24 is filled. The tube 24 may be conveniently detached from the machine and loaded onto an ammunition assembly apparatus as previously described.

It will be understood that various modifications and additions to the apparatus disclosed herein may be made and accordingly the foregoing description is not to be construed in a limiting sense.

What is claimed is:

1. Apparatus for lubricating and sizing slugs for use in manufacturing ammunition comprising: a source of semifluid lubricating material, a body having a first presized passage for receiving slugs for intermittent movement therethrough and a second passage communicating with the source of lubricating material, first means for metering slugs through the first passage, second means for metering lubricant from the second passage to the first passage, and power means for cyclically operating the first and second means in a predetermined timed relationship whereby the lubricating material is applied to the exterior of each of said slugs while in said first passage, the second means including a plunger cylinder formed in said body and intersecting the first and second passages, a lubricating pump plunger reciprocally carried in the cylinder, and drive means mechanically driving the pump plunger and interconnected with the power means to be driven thereby, means associated with said source for pressurizing the lubricating material to urge the material into the second passage, the plunger operating to discommunicate the source from the second passage when in a position which applies additional pressure to the lubricating material in the plunger cylinder, a third passage interconnecting the first passage with the second passage, and check valve means in the third passage for allowing the flow of excess lubricating material from the first passage to the second passage when the pressure applied by the plunger exceeds the pressure of the source.

2. Apparatus as defined in claim 1 wherein said power means includes a motor, a ram mounted for reciprocal movement on guide means attached to said body and a crank connected between said motor and said ram for producing reciprocating movement of said ram.

3. Apparatus as defined in claim 2 including a pusher projecting from said ram and in alignment with at least a portion of the first passage for intermittently urging the slugs through the first passage as said ram reciprocates.

4. Apparatus as defined in claim 1 wherein the first meter means includes a stacked slug source disposed in offset relationship with at least a portion of the first passage and a transfer member reciprocally displaceable between the slug stack and the first passage and having a single slug receptacle which is alternately alignable with the slug stack and the first passage for cyclically carrying slugs from the stack to the first passage.

5. Apparatus as defined in claim 4 wherein said power means includes a ram mounted for reciprocal motion on guide means connected to the body, said ram being mechanically connected to the transfer mechanism for reciprocating same.

6. Apparatus as defined in claim 1 wherein the first passage comprises a vertical portion for sequentially receiving slugs, a horizontal portion wherein the lubricant is applied to the slugs and a turning portion smoothly interconnecting the first and second portion to permit slugs to pass from one portion to the other.

7. Apparatus as defined in claim 6 including a removable sizing die secured within said body and forming a part of the horizontal portion of the first passage.

8. Apparatus as defined in claim 7 wherein said slugs have lubrication grooves formed circumferentially therein, said die having a plurality of axially spaced lubrication ports in communication with said second passage and registering with lubrication grooves in said slugs when said slugs are in the first passage.

9. Apparatus as defined in claim 1 wherein the power means comprises a motor, and first and second chain drives interconnecting the motor with the first and second metering means.

10. Apparatus as defined in claim 1 wherein the source comprises a rigid cylindrical container for said lubricating material threadedly removably engaged with said body, a pressure cup disposed within the cylinder and a coil spring disposed in compressed condition within the cylinder and biased against the pressure cup to apply internal pressure to the lubricating material tending to cause said lubricating material to flow into said second passage.

11. Apparatus for lubricating and sizing slugs for use in manufacturing ammunition comprising: a body defining a slug passage and a lubricant passage intersecting the slug passage, a source of lubricant under pressure connected to the lubricant passage, a sizing die removably disposed in said body and forming part of the slug passage, means for intermittently metering slugs into the slug passage and comprising means forming a substantially vertical passage having a smooth curve which terminates into the sizing die such that slugs falling through the vertical passage carry around the curve and into the sizing die, intermittently operated ram means extending into the curved portion of the passage for pushing slugs into and through the sizing die, transfer means for metering slugs, one at a time, from a supply tube into the passage, a cover plate removably mounted on and over at least a portion of the vertical slug passage and forming a wall of the passage, plunger means reciprocally disposed in the lubricant passage for applying additional pressure to the lubricant in the lubricant passage and power means for driving the transfer means, the ram and the plunger means.

12. Apparatus as defined in claim 11 wherein the cover plate is fabricated of a substantially transparent material.

* * * * *